US007252445B2

(12) United States Patent
Sakai

(10) Patent No.: US 7,252,445 B2
(45) Date of Patent: Aug. 7, 2007

(54) APPARATUS AND METHOD FOR FORMING IMAGES

(75) Inventor: Shuji Sakai, Kadoma (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 210 days.

(21) Appl. No.: 11/196,444

(22) Filed: Aug. 4, 2005

(65) Prior Publication Data

US 2006/0029453 A1 Feb. 9, 2006

(30) Foreign Application Priority Data

Aug. 9, 2004 (JP) ..... 2004-231835

(51) Int. Cl.
*B41J 29/38* (2006.01)

(52) U.S. Cl. ..... 400/578; 400/624; 399/394

(58) Field of Classification Search ..... 400/578, 400/583, 624, 629; 399/394
See application file for complete search history.

(56) References Cited

U.S. PATENT DOCUMENTS 6,125,258 A * 9/2000 Umetani et al. ..... 399/394
7,147,391 B2 * 12/2006 Matsushima et al. ..... 400/624

FOREIGN PATENT DOCUMENTS

JP 5-69608 3/1993
JP 2003-39759 2/2003
JP 2003-335433 11/2003

* cited by examiner

*Primary Examiner*—Minh Chau
(74) *Attorney, Agent, or Firm*—Armstrong, Kratz, Quintos, Hanson & Brooks, LLP

(57) ABSTRACT

The present invention provides an image forming apparatus for forming an image on printing paper by rolling up the printing paper around a cylindrical or column-shaped member without any fixture, that can measure with a high accuracy the length of the printing paper during transport thereof. The image forming apparatus of the present invention forms an image on printing paper in a state in which the printing paper is rolled up around an outer circumferential surface of a cylindrical or column-shaped member, and includes a sensor for detecting a front end or a rear end of the printing paper on the outer circumferential surface and a controller for calculating a length of the printing paper. The sensor, after having detected the rear end with the printing paper completely rolled up around the member, detects the front end along with rotation of the member. The controller calculates the length of the printing paper based on an operation amount of the member or a mechanism associated with driving of the member during a period from a detection of the rear end by the sensor until a detection of the front end.

20 Claims, 6 Drawing Sheets

APPARATUS AND METHOD FOR FORMING IMAGES

BACKGROUND OF THE INVENTION

1. Field of the Invention

This invention relates to an apparatus for forming images on printing paper such as printers, and more particularly relates to an apparatus for forming images that measures the length of the printing paper while transporting the printing paper.

2. Description of the Related Art

A printer that is directly connected to an imaging device such as a digital still camera and outputs images taken and recorded with the imaging device on relatively small-size printing paper such as post-card size or L size has become widespread recently. With this type of printer, users execute a process of outputting images of their own shooting without any professional help on the printing paper. The printer is requested to print out images without any white space on all sides, that is, with no margins in the periphery of the printing paper, because professionals often print the images taken with silver salt cameras on the printing paper, leaving no margins.

A heat transfer printer disclosed in JP 2003-39759A is equipped with a structure best suited to form images on printing paper without any white space on all sides. In the printer, a plurality of contact members are equipped around a platen roller and are biased towards the outer circumferential surface of the platen roller, the outer circumferential surface being covered with a material having a high coefficient of friction. In an image forming apparatus in which printing paper is fixed on a platen-roller (or a rotating drum and the like) with a fixture such as a clamper or a chuck, it is very difficult to form images with no white space on all sides, whereas this printer, by employing the above-mentioned structure, can roll up printing paper around a platen roller without a fixture to form images with no margins.

When forming images with no white space on all sides, in an image-forming apparatus such as the heat transfer printer, what is known as "overprinting" occurs on the portions not covered with the printing paper. A large amount of ink on the outer circumferential surface of a platen-roller caused by excessive overprinting results in smearing the back face of the printing paper. Furthermore, the adhesion of an overcoating agent on the outer circumferential surface of the platen roller causes malfunction of a sensor provided inside a printer. This is why a conventional image-forming apparatus is configured to control image forming mechanism such as the thermal head so as to perform overprinting appropriately. Besides dealing with a variety of printing paper sizes, an image forming apparatus is designed to control an image forming mechanism so as to perform overprinting appropriately according to the length of the printing paper measured at the time of being transported to the platen roller for the purpose of handling a little variation seen in printing paper size.

Measuring the length of the printing paper in the process of being transported to the platen roller is not only limited to an image forming apparatus with a function of forming images without any white space on all sides, but is widely found in many other image forming apparatuses (cf. JP H5-69608A and JP 2003-335433A). Generally, the length of the printing paper is measured as follows. First, at least the rear end of the printing paper is detected by a contact or non-contact type sensor. And then the rotation angle of the platen roller or the number of revolutions of a driving motor or the like during a period from the predetermined state until when the rear end of the printing paper is detected, or from when the front end of the printing paper is detected until when the rear end is detected are measured. Finally, the length of the printing paper is calculated based on the obtained rotation angle or the like and several constants (e.g. platen roller diameter, etc.).

However, as a printer disclosed in JP 2003-39759A, in an image forming apparatus that rolls up printing paper around a platen roller without any fixture, when measuring the length of the printing paper by detecting the end of the printing paper, the length of the printing paper may not be obtained with a sufficient accuracy. With this type of image forming apparatus, a slip of the printing paper (or its displacement) can occur on the platen roller during transport, when the contact area is not sufficiently ensured between the outer circumferential surface of the platen roller and the printing paper. When a slip occurs, the rotation angle of the platen roller or the number of revolutions of the driving motor or the like employed in calculating the length of the printing paper become greater than in the case where no slip occurs. As a result, the measured length of the printing paper becomes greater than its real length.

SUMMARY OF THE INVENTION

In view of the above-described problems, it is an object of the present invention to provide an image forming apparatus that, by rolling up printing paper around a cylindrical or column-shaped member such as a platen roller or a rotating drum without any fixture, forms an image on the printing paper and can measure with a high accuracy the length of the printing paper during transport of the printing paper. Furthermore, the present invention provides a method for measuring the length of the printing paper with a high accuracy when transporting the printing paper in such an image forming apparatus.

An image forming apparatus of the present invention is an image forming apparatus that forms an image on printing paper in a state in which the printing paper is rolled up around an outer circumferential surface of a cylindrical or column-shaped member, and includes a sensor for detecting a front end or a rear end of the printing paper on the outer circumferential surface and a controller for calculating a length of the printing paper. After having detected the rear end in a state in which the printing paper is completely rolled up around the member, the sensor detects the front end along with rotation of the member. The length of the printing paper is obtained based on an operation amount of the member or a mechanism associated with driving of the member during a period from a detection of the rear end by the sensor until a detection of the front end.

The method of the present invention is a method for measuring a length of printing paper during transport of the printing paper in an image forming apparatus for forming an image on the printing paper in a state in which the printing paper is rolled up around an outer circumferential surface of a cylindrical or column-shaped member, the method including a first step of detecting a rear end of the printing paper using a sensor, in a state in which the printing paper is completely rolled up around the member, a second step of detecting, after the first step, a front end of the printing paper using the sensor, and a step of measuring the length of the printing paper based on the operation amount of the member or the mechanism associated with driving of the member from the first step to the second step.

The present invention can measure the length of printing paper with a sensor in a state in which the printing paper is completely rolled up around a member. There is no slip of the printing paper on the outer circumferential surface of the member during a period from when the sensor has detected the rear end of the printing paper until it detects the front end. Even if there is a slip, the extent is very low. Therefore, according the present invention, an image forming apparatus that forms an image on printing paper in a state in which the printing paper is rolled up around an outer circumferential surface of a member such as a platen roller is capable of measuring with a high accuracy the length of the printing paper during transport of the printing paper. Furthermore, in such an image forming apparatus, when measuring the length of the printing paper in a state in which the printing paper is completely rolled up around the member, a conventional method requires to rotate the member excessively. However, the image forming apparatus of the present invention measures the length of the printing paper, by detecting the rear end of the printing paper and then the front end, and by using the operation amount of the member or a mechanism associated with driving of the member during that period. Therefore, according to the present invention, the length of the printing paper can be measured with a high accuracy before the front end of the printing paper is transported to a position at which printing starts after arranging the front end of the printing paper on the outer circumferential surface of the member and rotating the member by about 360° from that state.

It is preferable that, for example, the member around which the printing paper is to be rolled up is driven by a stepping motor mechanism, and the operation amount used to measure the length of the printing paper is the number of driving pulses supplied from a controlling mechanism that controls the stepping motor mechanism to the stepping motor mechanism during a period from a detection of the rear end by the sensor until a detection of the front end. The stepping motor mechanism, for example, includes a stepping motor and a motor driver that drives it. The operation amount of the member is, for example, the rotation angle of the platen roller, and the operation amount (including operated amount) of the mechanism associated with driving of the member, for example, corresponds to the number of driving pulses or the number of revolutions of the driving motor for rotating the platen roller as described above.

BRIEF DESCRIPTION OF THE DRAWINGS

The objects and advantages of the present invention will be made clear and more easily understood, by reference to the drawings attached hereto and the following explanations related to typical preferable examples at the present stage.

DESCRIPTION OF THE PREFERRED EMBODIMENTS

Figure 1:
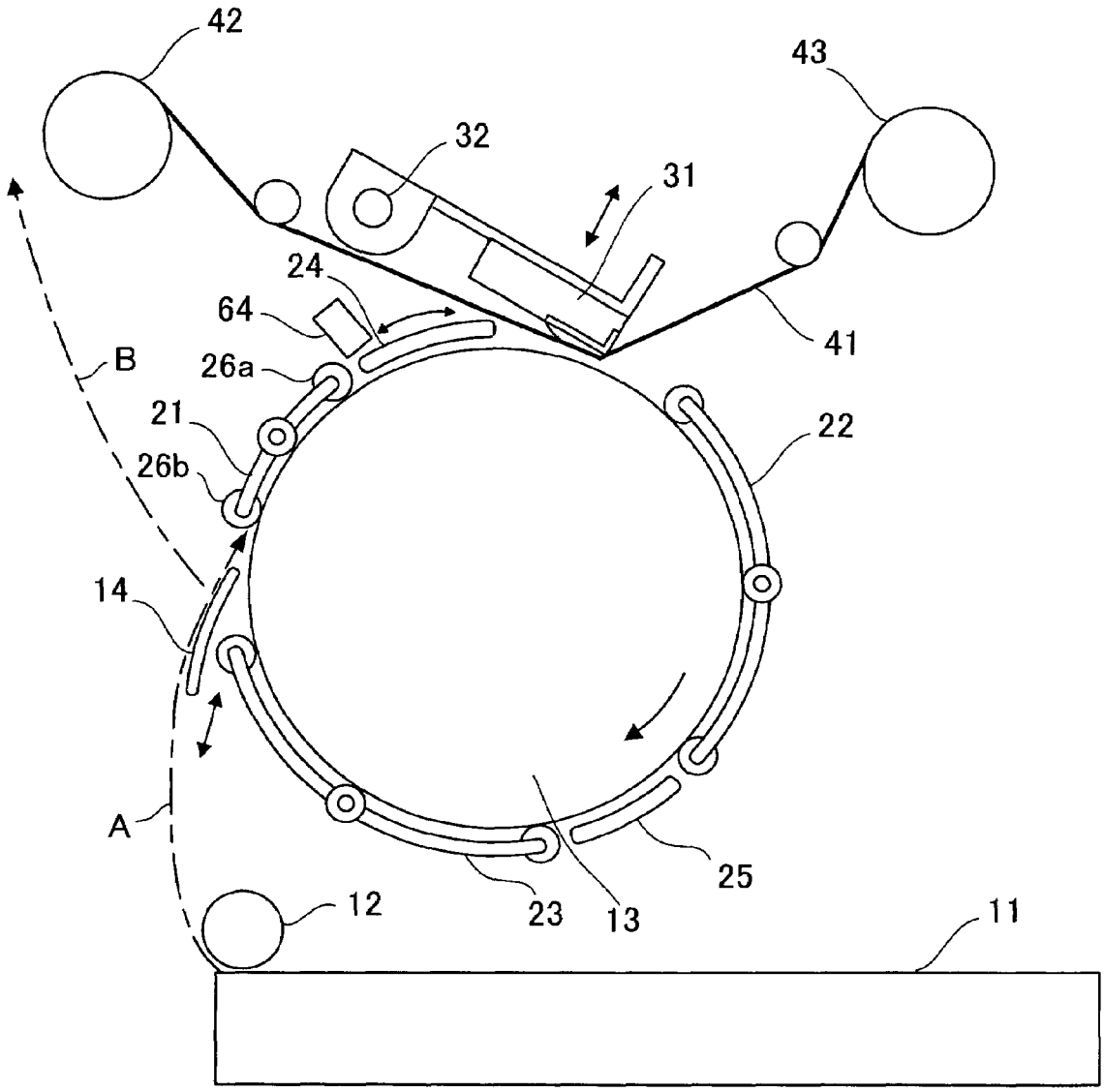
FIG. 1 is an explanatory diagram showing an outline of a printing mechanism of a heat transfer printer that is an example of the present invention.

Hereinafter, the present invention will be described with reference to the accompanying drawings. FIG. 1 is an explanatory diagram showing an outline of a printing mechanism of a heat transfer printer (hereafter referred to as "printer") that is an example of the image forming apparatus of the present invention. A cassette paper feed tray 11 is provided in a lower portion of a printer. Printing paper is contained while being piled up in the paper feed tray 11, and an end of printing paper on the top of the pile touches a paper feed roller 12 located above an end of the paper feed tray 11. In the paper feed tray 11, a plate member and biasing means (not shown) are provided. The printing paper is put on the plate member, which is biased upwards by the biasing means, so that the printing paper is pressed against a paper feeding rotation member, more particularly, the paper feed roller 12. Therefore, when rotating the paper feed roller 12, the printing paper on the top of the pile is let out from the paper feed tray 11.

In the printer in this example of the present invention, a platen roller 13 is provided above the paper feed tray 11 to reduce the size of the printer. The printer is provided with a guiding mechanism including a guide member 14, and the printing paper let out from the paper feed tray 11 is guided by the guiding mechanism and is transported towards the platen roller 13 along a path shown by a dashed dotted line A with an arrow in FIG. 1.

The printer of the present invention employs a method in which an image is formed (printed) on the printing paper while rotating the platen roller 13 with the printing paper rolled up around the platen roller 13. Around the column-shaped or cylindrical platen roller 13, a roll-up mechanism for rolling up the printing paper around the platen roller 13 is provided. The roll-up mechanism of the printer of this example includes first to third auxiliary devices 21, 22 and 23 and first and second guide plates 24 and 25, which are spaced apart from each other in the circumferential direction of the platen roller 13. The printing paper is inserted between the first to the third auxiliary devices 21, 22 and 23 and the platen roller 13. The first to the third auxiliary devices 21, 22 and 23 press the inserted printing paper against the outer circumferential surface of the platen roller 13. In FIG. 1, the platen roller 13 rotates in clockwise direction, and the first guide plate 24 serves to guide the printing paper from the first auxiliary device 21 to the second auxiliary device 22, and the second guide plate 25 serves to guide the printing paper from the second auxiliary device 22 to the third auxiliary device 23. Furthermore, the above-described guide member 14 is configured as a roll-up mechanism, and the guide member 14 serves to guide the printing paper from the third auxiliary device 23 to the first auxiliary device 21.

Figure 2:
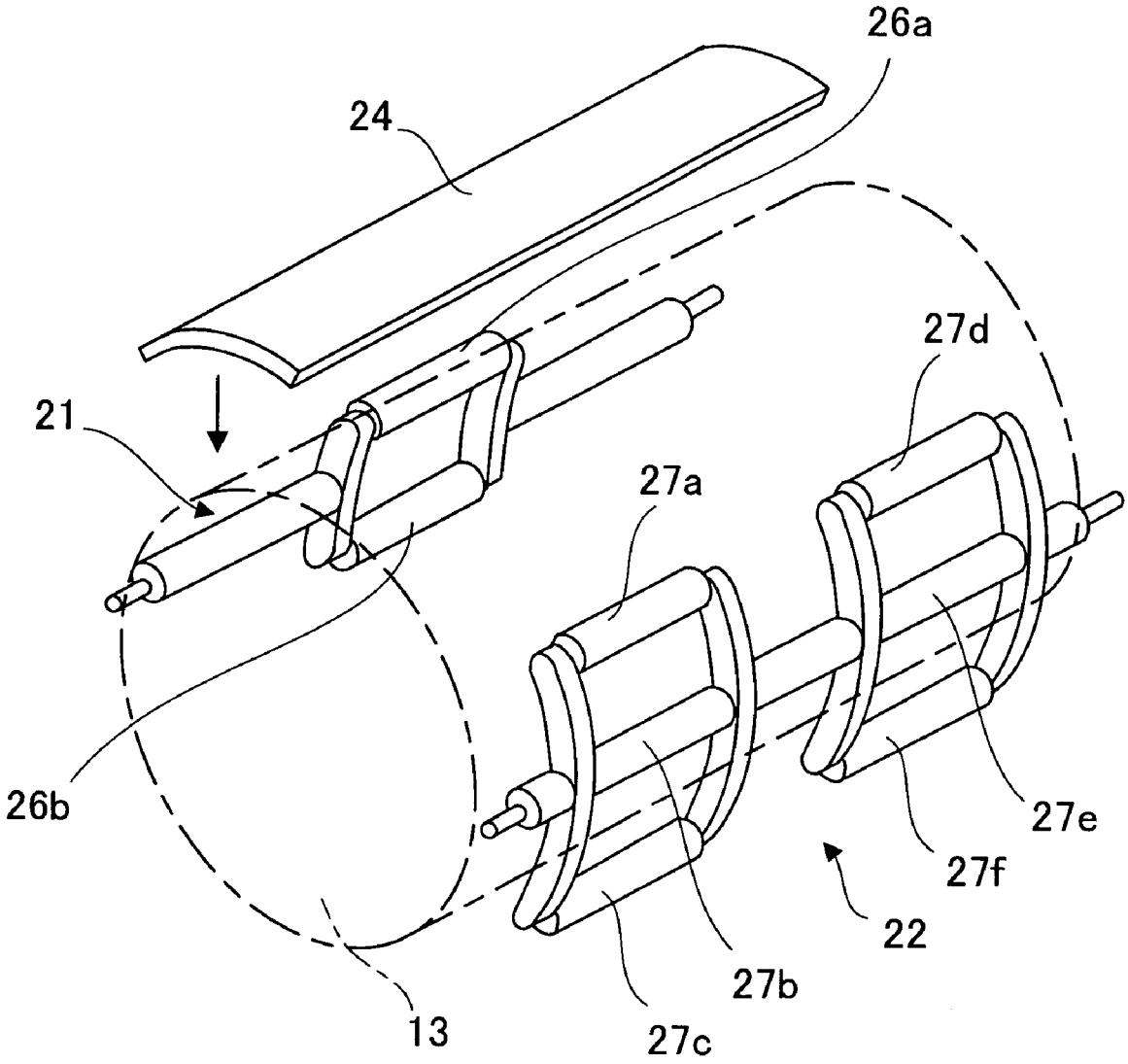
FIG. 2 is a perspective view showing a first and a second auxiliary devices and a first guide plate of the heat transfer printer that is an example of the present invention.

FIG. 2 is a perspective view showing the first and the second auxiliary devices 21 and 22 and the first guide plate 24. The first auxiliary device 21 is provided with two guide rollers 26*a* and 26*b* that are spaced apart from each other in the circumferential direction of the platen roller 13, and these guide rollers 26*a* and 26*b* are provided approximately in the center of the outer circumferential surface of the platen roller 13. The first auxiliary device 21 is biased towards the platen roller 13 with a bias member such as a spring (not shown), and the guide rollers 26*a* and 26*b* press the outer circumferential surface of the platen roller 13. The second auxiliary device 22 is provided with three guide rollers 27*a*, 27*b* and 27*c* that are spaced apart from each other in the circumferential direction of the platen roller 13 at one end of it and three guide rollers 27*d*, 27*e* and 27*f* similarly provided at the other end of the platen roller 13. The second auxiliary device 22 is biased towards the platen roller 13 with a bias member such as a spring (not shown), and the guide rollers 27*a-f* press the outer circumferential surface of the platen roller 13. The third auxiliary device 23 not shown in FIG. 2 is configured in the same manner as the second auxiliary device 22. The first guide plate 24, which is a plate member provided in the longitudinal direction of the platen roller 13, is bent along the outer circumferential surface of the platen roller 13. The second guide plate 25 (not shown) is formed substantially in the same manner as the first guide plate 24.

The front end of the printing paper fed out from the paper feed tray 11 is first sandwiched between the lower guide roller 26*b* provided in the first auxiliary device 21 and the platen roller 13. The outer circumferential surface of the platen roller 13 is covered with a material having a high coefficient of friction such as silicon rubber. Furthermore, when sandwiching the front end of the printing paper, the platen roller 13 is driven to rotate at the same transport rate as that of the paper feed roller 12. With this configuration, the front end of printing paper, after being sandwiched between the guide roller 26*b* and the platen roller 13, is transported smoothly in the circumferential direction of the platen roller 13. With a more portion rolled up around the outer circumferential surface of the platen roller 13 in proportion to the rotation of the platen roller 13, the printing paper is pressed against the outer circumferential surface of the platen roller 13 by the roll-up mechanism including the first to the third auxiliary devices 21, 22 and 23, and finally is rolled up around the platen roller 13 (see FIG. 5A to 5C).

The first guide plate 24 is located in such a manner that it can reciprocate freely in the circumferential direction of the platen roller 13. When rolling up the printing paper around the platen roller 13, the first guide plate 24 is provided approximately midway between the first and the second auxiliary devices 21 and 22, and the front end of the printing paper, after having passed through the first auxiliary device 21, is guided by a first guide plate 24 so as to be inserted between the second auxiliary device 22 and the platen roller 13 (see FIG. 5A to C). When forming an image on the printing paper, the first guide plate 24 is provided on the side of the first auxiliary device 21 as shown in FIG. 1, in order not to interfere with the thermal head 31 provided above the platen roller 13 (see FIG. 6C).

The thermal head 31 includes a multiple of heat generators (not shown) aligned in a plurality of lines in the longitudinal direction of the platen roller 13. The thermal head 31 is provided in such a manner that it can pivot freely around a spindle 32 and is free to get near to and away from the platen roller 13. When printing an image on the printing paper, the thermal head 31 is lowered so as to get near to the platen roller 13, as shown in FIG. 1. Below the thermal head 31, an ink ribbon 41 is provided, and a part of the ink ribbon 41 is pressed against the printing paper on the outer circumferential surface of the platen roller 13 by lowering the thermal head 31.

On the ink ribbon 41, regions to which yellow, magenta and cyan ink each adhere and a region to which an overcoating agent adheres are periodically formed. When forming a (color) image on the printing paper, first, a region to which yellow ink adheres is pressed against the front end of the printing paper, and the yellow ink is transferred on the printing paper by a heat generator of the thermal head 31 being heated. A yellow image is formed across the printing paper by rotating the platen roller 13 while the ink is transferred onto the printing paper. While the ink ribbon 41 is rolled up around a first roller 42, and its one end is tied up to a second roller 43. After the yellow image has been formed on the printing paper, the first roller 42 and the second roller 43 rotate and the ink ribbon 41 is sent forth in such a manner that a region to which magenta ink adheres is located below the thermal head 31. Thereafter, a magenta image is formed on the printing paper in the same manner. After the magenta image has been formed, a cyan image is formed on the printing paper, and furthermore, an overcoating layer is formed. At this point, a process of forming an image on the printing paper is completed. When image formation is completed, the thermal head 31 moves upwards, the first guide plate 24 moves towards the second auxiliary device 22, and the guide member 14 moves downwards. When the printing paper is transported with the rotation of the platen roller 13, the front end of the printing paper is guided, after passing through the third auxiliary device 23, not below the first auxiliary device 21 but to a discharge path shown by a dashed dotted line B with an arrow in FIG. 1, and the printing paper is discharged or output outside the printer.

Figure 3:
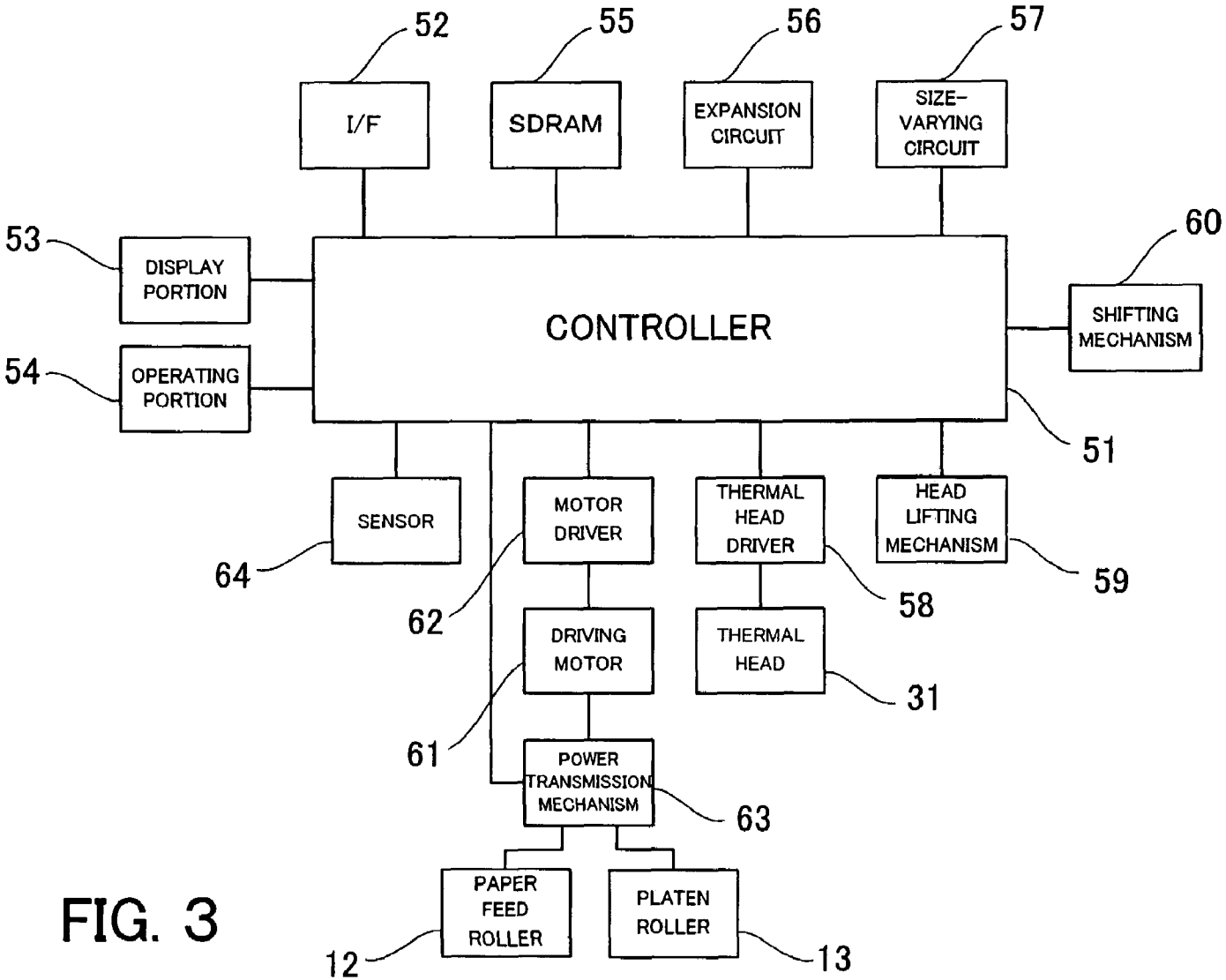
FIG. 3 is a block diagram showing the outline of the heat transfer printer that is an example of the present invention.

FIG. 3 is a block diagram showing the outline of the printer. The printer includes CPU, RAM and ROM, and is provided with a controller (a control system) 51 for controlling various operations and executing various kinds of processing. The controller 51 is provided with an interface portion 52 that establishes a connection for telecommunications between the printer and an external device such as an image-capturing apparatus and a personal computer. To the interface portion 52, one end of a connecting cable (not shown) connected to an external device is connected. For example, the printer and the external device are connected through a USB (Universal Serial Bus) cable and use USB to exchange data between them.

When the external device and the printer are connected, a list of image data stored in a storage medium of the external device is shown on a display portion 53. As the display portion 53, for example, a LCD (Liquid Crystal Display) is employed. When a user selects an image that is desired to be output by operating an operating portion 54, the image data is sent from the external device to the printer and is stored in a SDRAM (Synchronous Dynamic Random Access Memory) 55. The image data is compressed based on, for example, a JPEG (Joint Photographic Experts Group) format. The image data stored in the SDRAM 55 is sent to an expanding circuit 56 to be subjected to be expanded, and further is sent to a size-varying circuit 57 to be scaled up or down. After these processes are performed, the controller 51 sends a command to a thermal head driver 58 based on the image data, and the thermal head driver 58 causes the heat generator of the thermal head 31 to generate heat. Also, the printer is provided with a head lifting mechanism 59 including an actuator or the like that operates when lifting or lowering the thermal head 31 and further is provided with a shifting mechanism 60 including an actuator or the like that operates when shifting the guide member 14 and the first guide plate 24. The head lifting mechanism 59 and the shifting mechanism 60 are controlled by the controller 51.

The printer is provided with a driving motor 61 that rotates the paper feed roller 12 and the platen roller 13. In this example, as the driving motor 61, a stepping motor mechanism is employed. The controller 51 sends driving pulses to a motor driver 62, which rotates the driving motor 61 by the angle in proportion to the number of driving pulses that have been sent. The driving motor 61 is connected to the paper feed roller 12 and the platen roller 13 via a power transmission mechanism 63. The power transmission mechanism 63 includes a clutch, and power supply to the paper feed roller 12 is stopped by declutching.

The printer is provided with a sensor 64 detecting the front end and the rear end of the printing paper on the platen roller 13. In this example, a non-contact type optical sensor is employed as the sensor 64. As is shown in FIG. 1, the sensor 64 is located near one end of the first auxiliary device 21 and detects the front and the rear end of the printing paper passing through the first auxiliary device 21.

Figure 4:
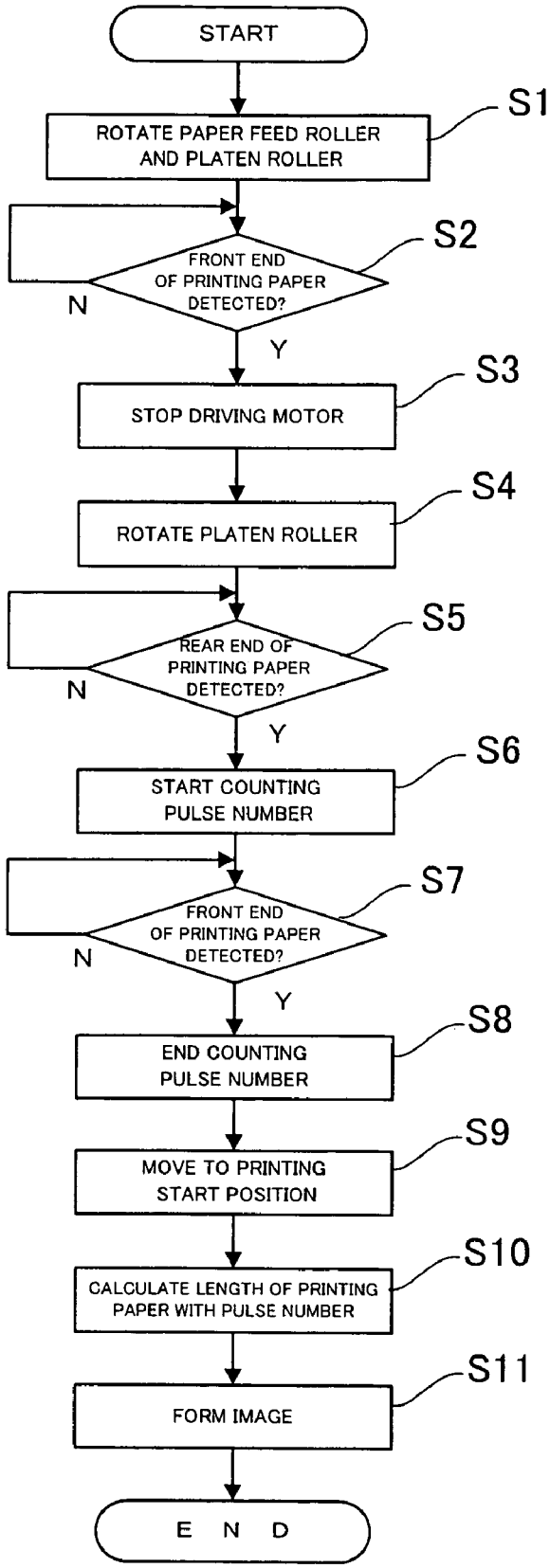
FIG. 4 is a flowchart showing an image formation operation of the heat transfer printer that is an example of the present invention.
Figure 5C:
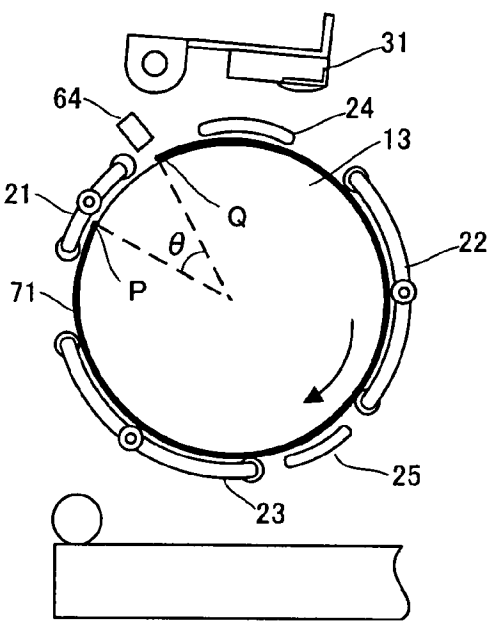
FIG. 5A to 5C are each an explanatory diagram showing the state of the heat transfer printer that is an example of the present invention at each stage of the image formation operation.
Figure 5B:
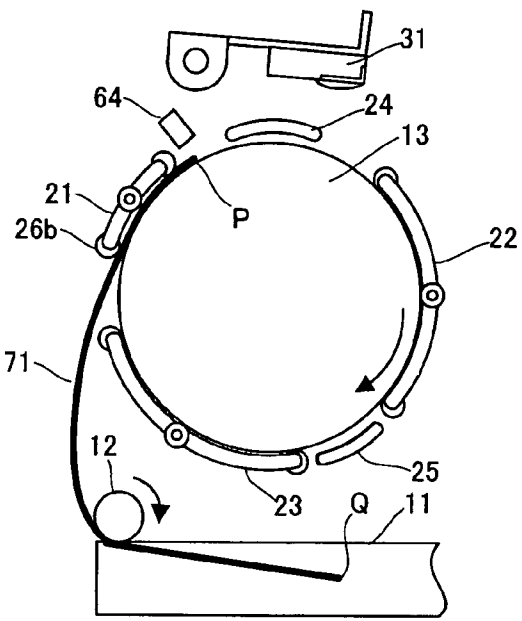
Figure 5A:
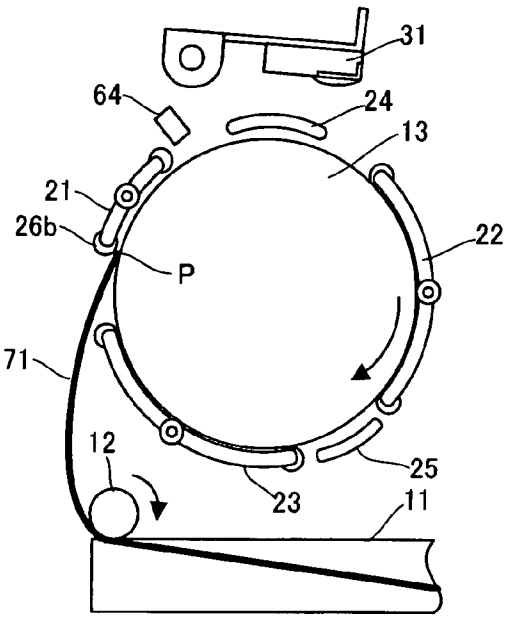

The following is a detailed explanation of the operation of the printer of this example for measuring the length of the printing paper. FIG. 4 is a flowchart showing an operation of the printer for forming an image. FIGS. 5A to 5C and 6A to 6C are each an explanatory diagram showing the state of the printer. After image data output on the printing paper is stored in the SDRAM 55 and is subjected to expanding and size-varying processing or other processing, an operation of forming an image is started, for example, by a user operating the operating portion 54. As shown in FIG. 4, first of all, the controller 51 sends a driving pulse to the motor driver 62, which rotates both the paper feed roller 12 and the platen roller 13 (S1). In addition, these rollers 12 and 13 are rotated in such a manner that they generate the same transport speed. By rotating the paper feed roller 12, the printing paper 71 is fed out from the paper feed tray 11. The printing paper 71 moves towards the platen roller 13 through a path shown by a dashed dotted line A in FIG. 1. As shown in FIG. 5A, the front end P of the printing paper 71 is sandwiched between the lower guide roller 26*b* provided in the first auxiliary device 21 and the platen roller 13.

With the rotation of the platen roller 13, the front end P of the printing paper 71 moves in the circumferential direction of the platen roller 13. As is shown in FIG. 5B, when the front end P of the printing paper 71 is let out from under the first auxiliary device 21 and is positioned below the sensor 64, the sensor 64 sends a signal showing that the front end P of the printing paper 71 has been detected. The controller 51 determines as to the presence or absence of the signal from the sensor 64 (S2), and when the signal is sent from the sensor 64, that is to say, when the sensor 64 has detected the front end P of the printing paper 71, the controller 51 ceases to supply driving pulses to the motor driver 62, and the driving motor 61 as well as the paper feed roller 12 and the platen roller 13 stop (S3).

After the step S3, the controller 51 controls the power transmission mechanism 63 to declutch so as to stop power supply from the driving motor 61 to the paper feed roller 12. Then, the controller 51 sends again a driving pulse to the motor driver 62 to rotate the platen roller 13 (S4) alone. After the step S4, the printing paper 71 is transported only by the rotation of the platen roller 13. With the rotation of the platen roller 13, the printing paper 71 is transported in clockwise direction from the state shown in FIG. 5B and let completely out of the paper feed tray 11. Then, the printing paper 71, as shown in FIG. 5C, is completely rolled up around the platen roller 13 and the rear end Q of the printing paper 71 is moved below the sensor 64. When the rear end Q of the printing paper 71 is positioned below the sensor 64, the sensor 64 sends a signal showing that the rear end Q of the printing paper 71 has been detected to the controller 51. The controller 51 determines as to the presence or absence of the signal from the sensor 64 (S5), and when the signal is sent from the sensor 64, that is to say, when the sensor 64 has detected the rear end Q of the printing paper 71, the controller 51 starts counting or monitoring the number of driving pulses supplied to the motor driver 62 (S6).

Figure 6C:
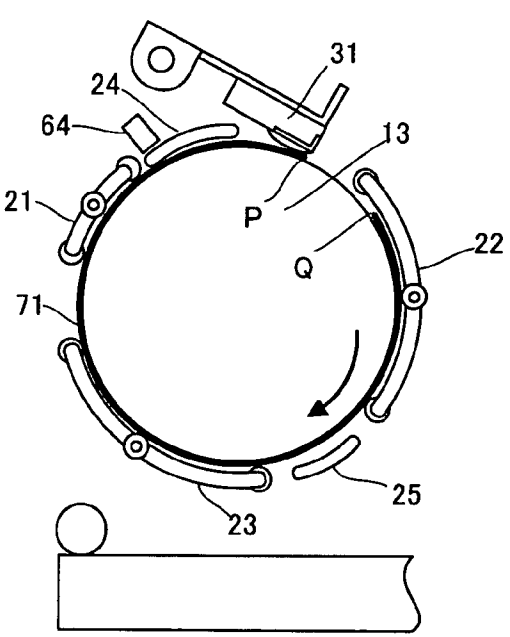
FIG. 6A to 6C are each an explanatory diagram showing the state of the heat transfer printer that is an example of the present invention at each stage of the image formation operation.
Figure 6B:
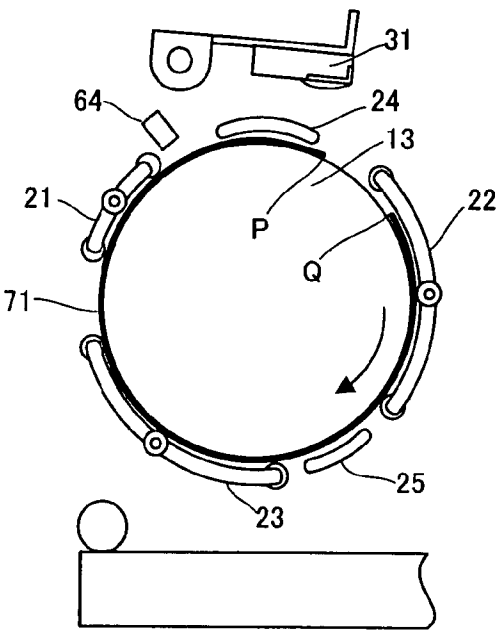
Figure 6A:
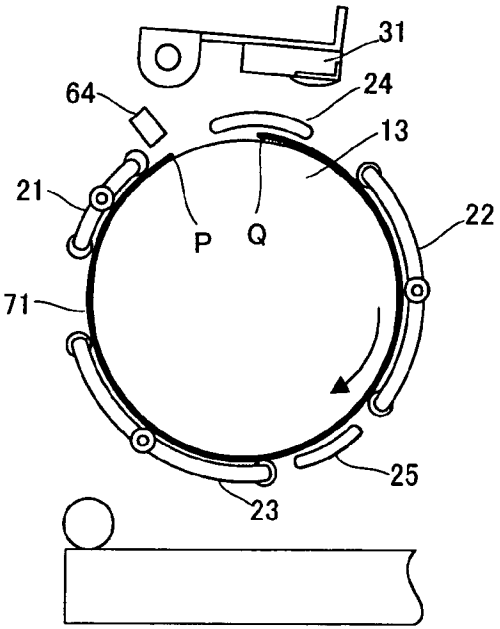

When the platen roller 13 rotates from the state shown in FIG. 5C by the angle θ shown in the FIG. 5C, the front end P of the printing paper 71, as shown FIG. 6A, is positioned below the sensor 64 again (the front end P of the printing paper 71 has been turned by 360° from the state shown in FIG. 5B). Herein, the angle θ is formed by a straight line passing through the centre of the platen roller 13 and the front end P of the printing paper 71 and a straight line passing through the center of the platen roller 13 and the rear end Q of the printing paper 71. As with the case above-described, when the front end P of the printing paper 71 is positioned below the sensor 64, the sensor 64 sends a signal showing that the front end P of the printing paper 71 has been detected to the controller 51. The controller 51 determines as to the presence or absence of the signal from the sensor 64, and when the signal is sent from the sensor 64, that is to say, when the front end P of the printing paper 71 is positioned below the sensor 64 (S7), the controller 51 ceases to count the number of driving pulses and stores the number N of pulses counted (S8). The platen roller 13 continues rotating, and after the step S8, as is shown in FIG. 6B, when the printing paper 71 is positioned at the starting position of the image forming process (the starting position of printing), that is to say, the front end P of the printing paper 71 is positioned at the prescribed position below the thermal head 31, then the rotation of the platen roller 13 is stopped (S9). The controller 51 stores in advance the number of driving pulses needed to rotate the platen roller 13 from the state shown in FIG. 6A to that shown in FIG. 6B, and after the step S8, the controller 51 supplies as many driving pulses as it has stored to the motor driver 62.

After the step S9, the controller 51 calculates the length of the printing paper 71 with the number N of pulses counted, that is to say, the number of driving pulses supplied to the motor driver 62 during the period between the detection of the rear end Q of the printing paper 71 and the detection of the front end P thereof (S10). The length L of the printing paper 71 can be obtained by a formula $L=(2\pi-\Delta\theta\times N)\times R$, where R is the radius of the platen roller 13, $\Delta\theta$(rad) is a rotation angle of the platen roller 13 per a driving pulse, and $\Delta\theta\times N$ is equal to the above-described angle θ. As shown in FIG. 5C, since the printing paper 71 is completely rolled up around the platen roller 13 at the start of counting the number N of driving pulses, no slip, or little, if any, slip, can be seen on the outer circumferential surface of the platen roller 13 during a period between the point in which the rear end Q of the printing paper 71 is positioned below the sensor 64 and the point in which the platen roller 13 has been rotated by the angle θ. Therefore, in the step S10, the length L of the printing paper 71 can be obtained with a remarkably high accuracy. In addition, the step S10 may be performed parallel with the step S9.

After the step S10, a process for forming an image on the printing paper 71 is performed (S11). First, the first guide plate 24 moves to the side of the first auxiliary device 21, and the thermal head 31 approaches the platen roller 13. The region of the ink ribbon 41 to which yellow ink adheres is pressed on the front end P of the printing paper 71 by the thermal head 31 that has come down. Based on the image data stored in the SDRAM 55, the thermal head 31 is heated while rotating the platen roller 13 so that a yellow image is formed on the printing paper 71. At this point, the controller 51 controls the thermal head 31 and other portions based on the length L of the printing paper obtained in the step S10.

For example, the controller 51 determines, based on the length L of the printing paper, a length H of a region to which ink is actually transferred and determines when to stop printing and the like based on this length. Thus, not only can a region where overprinting occurs be optimized, but also can an image without any white space on all sides be formed reliably on the printing paper 71. More specifically, the length H of the region to which ink is actually transferred is determined as $\alpha+L+\beta$, where $\alpha$ is the length of a region where overprinting occurs on the side of the front end of the printing paper 71, and $\beta$ is the length of a region where overprinting occurs on the side of the rear end of the printing paper 71. The values $\alpha$ and $\beta$ are determined in such a manner that overprinting always occurs but not more than necessary and an image without any white space on all sides is formed reliably on the printing paper 71, in view of an error of the obtained length L of the printing paper and a variation of the diameter of the platen roller (from printer to printer) and the like (for example, the values $\alpha$ and $\beta$ are set to be about 1 mm). In addition, a similar control is performed when inks other than yellow and a coating agent are transferred.

When a yellow image has been formed across the printing paper 71, and the lifting or lowering of the thermal head 31 and the let-off of the ink ribbon 41 has been performed, the printer moves again to the state shown in FIG. 6C. The let-off of the ink ribbon 41 is performed, and the region of the ink ribbon 41 to which magenta ink adheres is pressed on the front end of the printing paper 71. Hereafter, a magenta image is formed on the printing paper 71 in the same manner as above, and furthermore a cyan image is formed on the printing paper 71. Finally, a coating agent is transferred on the printing paper 71 in the same manner as above, an over-coat layer is formed on the printing paper 71. Thus, the process for forming a (color) image on the printing paper 71 is completed. Thereafter, a process for discharging the printing paper 71 outside the printer is performed, as described above.

In the above-described example, the length L of the printing paper 71 is calculated based on the number N of driving pulses supplied to the motor driver 62 by the controller 51 while the sensor 64 is detecting the rear end Q and the front end P of the printing paper 71. However, if an encoder is provided in the platen roller 13 to measure the above-described angle $\theta$, the length L of the printing paper 71 is allowed to be measured by this measured angle $\theta$. Therefore, the driving motor 61 used in the present invention, as seen in the example, is not limited to a stepping motor. In addition, a formula employed to calculate the length L of the printing paper 71 can be an equivalent to the above-described formula that includes implicitly or explicitly the angle $\theta$ or $\Delta\theta$. Furthermore, the present invention is applicable for a printer of a different printing method such as an ink-jet printer in addition to a heat transfer printer, and even for a copier and a facsimile, and is also widely applicable for an image forming apparatus that forms an image on printing paper rolled up around a cylindrical or column-shaped member such as the platen roller.

The description of the above-mentioned examples is merely illustration of the present invention, and is not intended to limit the invention as described to the claims, or should not be construed so as to reduce the scope of the claims. In addition, the configuration of the components of the present invention is not limited to the above-described examples, and various modifications are, of course, possible within the technological scope described in the claims.

What is claimed is:

1. An image forming apparatus for forming an image on printing paper in a state in which the printing paper is rolled up around an outer circumferential surface of a cylindrical or column-shaped member, comprising:

a sensor for detecting a front end or a rear end of the printing paper on the outer circumferential surface and a controller for calculating a length of the printing paper;

wherein the sensor, after having detected the rear end with the printing paper completely rolled up around the member, detects the front end along with rotation of the member;

wherein the controller calculates the length of the printing paper based on an operation amount of the member or a mechanism associated with driving of the member during a period from a detection of the rear end by the sensor until a detection of the front end.

2. The image forming apparatus according to claim 1, wherein the member is driven by a stepping motor mechanism, and the operation amount is a number of driving pulses supplied from a controlling mechanism that controls the stepping motor mechanism to the stepping motor mechanism during a period from a detection of the rear end by the sensor until a detection of the front end.

3. The image forming apparatus according to claim 2, wherein the controller calculates the length of the printing paper based on a formula: $L=(2\pi-\Delta\theta\times N)\times R$, wherein L is the length of the printing paper, R is a radius of the outer circumferential surface of the member, and $\Delta\theta$ is a rotation angle of the member per one driving pulse.

4. The image forming apparatus according to claim 1, wherein a roll-up mechanism is provided around the member, wherein the roll-up mechanism is provided with a plurality of guide rollers biased towards the outer circumferential surface of the member, wherein the printing paper is rolled up around the outer circumferential surface of the member while being sandwiched between the plurality of guide rollers and the outer circumferential surface of the member.

5. The image forming apparatus according to claim 4, wherein the printing paper is let out from a paper feed tray and fed out to the member by rotation of a paper feed roller pressed against the printing paper.

6. The image forming apparatus according to claim 5, wherein the member and the paper feed roller rotate both at the same transport rate, when the printing paper is fed out from the paper feed tray to the member.

7. The image forming apparatus according to claim 6, wherein when the sensor detects the front end for the first time after a part of the printing paper is sandwiched between the roll-up mechanism and the member, only the member is rotated so that the printing paper is transported.

8. The image forming apparatus according to claim 7, wherein the controller starts monitoring the operation amount when the sensor detects the rear end, after having detected the front end of the printing paper for the first time.

9. The image forming apparatus according to claim 1, wherein the member is a platen roller.

10. The image forming apparatus according to claim 1, wherein the sensor is a non-contact sensor.

11. A method for measuring a length of printing paper during transport of the printing paper in an image forming apparatus for forming an image on the printing paper in a state in which the printing paper is rolled up around an outer circumferential surface of a cylindrical or column-shaped member, the method comprising:

a first step of detecting a rear end of the printing paper using a sensor, in a state in which the printing paper is completely rolled up around the member, a second step of detecting, after the first step, a front end of the printing paper using the sensor, and a step of measuring the length of the printing paper based on the operation amount of the member or the mechanism associated with driving of the member from the first step to the second step.

12. The method according to claim 11, wherein the member is driven by a stepping motor mechanism, and the operation amount is a number of driving pulses supplied from a controlling mechanism that controls the stepping motor mechanism to the stepping motor mechanism during a period from a detection of the rear end by the sensor until a detection of the front end.

13. The method according to claim 12, wherein in the step of measuring the length of the printing paper, the length of the printing paper is calculated based on a formula: $L=(2\pi-\Delta\theta\times N)\times R$, wherein L is the length of the printing paper, R is a radius of the outer circumferential surface of the member, and $\Delta\theta$ is a rotation angle of the member per one driving pulse.

14. The method according to claim 11, wherein a roll-up mechanism is provided around the member, wherein the roll-up mechanism is provided with a plurality of guide rollers biased towards the outer circumferential surface of the member, and the method further comprising a step of rolling up the printing paper around the outer circumferential surface of the member while being sandwiched between the plurality of guide rollers and the outer circumferential surface of the member.

15. The method according to claim 14, further comprising a step of rotating a paper feed roller pressed against the printing paper to let out the printing paper from a paper feed tray and to feed it to the member.

16. The method according to claim 15, wherein in the step of feeding out the printing paper to the member, the member and the paper feed roller rotate both at the same transport rate.

17. The method according to claim 16, further comprising a step of rotating only the member to transport the printing paper, when the sensor detects the front end for the first time after a part of the printing paper is sandwiched between the roll-up mechanism and the member.

18. The method according to claim 17, further comprising a step of monitoring the operation amount, when the sensor detects the rear end, after having detected the front end of the printing paper for the first time.

19. The method according to claim 11, wherein the member is a platen roller.

20. The method according to claim 11, wherein the sensor is a non-contact sensor.

* * * * *